US009091434B2

(12) United States Patent
Agrawal et al.

(10) Patent No.: US 9,091,434 B2
(45) Date of Patent: Jul. 28, 2015

(54) MESO-SCALED COMBUSTION SYSTEM

(75) Inventors: Ajay K. Agrawal, Tuscaloosa, AL (US); Sadasivuni Vijaykant, Greer, SC (US)

(73) Assignee: The Board of Trustees of the University of Alabama, Tuscaloosa, AL (US)

( * ) Notice: Subject to any disclaimer, the term of this patent is extended or adjusted under 35 U.S.C. 154(b) by 1023 days.

(21) Appl. No.: 12/988,231

(22) PCT Filed: Apr. 20, 2009

(86) PCT No.: PCT/US2009/041175

§ 371 (c)(1),
(2), (4) Date: Nov. 10, 2010

(87) PCT Pub. No.: WO2009/129547

PCT Pub. Date: Oct. 22, 2009

(65) Prior Publication Data

US 2011/0045425 A1 Feb. 24, 2011

Related U.S. Application Data

(60) Provisional application No. 61/046,403, filed on Apr. 18, 2008.

(51) Int. Cl.
*F23D 3/40* (2006.01)
*F23C 99/00* (2006.01)
(Continued)

(52) U.S. Cl.
CPC ..... *F23C 99/006* (2013.01); *F23D 14/14* (2013.01); *F23C 2900/03001* (2013.01); *F23D 14/12* (2013.01)

(58) Field of Classification Search
CPC ... F23D 14/12; F23D 2212/201; F23D 14/66; F23D 2203/105; F23D 14/14
USPC ..... 431/326, 115, 215; 136/205
See application file for complete search history.

(56) References Cited

U.S. PATENT DOCUMENTS 3,196,614 A 7/1965 Toone et al.
3,785,570 A * 1/1974 Krieger ..... 239/401
(Continued)

FOREIGN PATENT DOCUMENTS

AU 784815 A1 3/2003
EP 0059855 9/1982
(Continued)

OTHER PUBLICATIONS

Gañán-Calvo, Alfonso M., "Enhanced liquid atomization: From flow-focusing to flow-blurring," Appl. Phys. Lett., vol. 86, Issue 21, 2005, pp. 214101-1 to 214101-3.

*Primary Examiner* — Avinash Savani
*Assistant Examiner* — George R Blum
(74) *Attorney, Agent, or Firm* — Meunier Carlin & Curfman LLC

(57) ABSTRACT

A meso-scaled combustion system. In one aspect, the system has a housing with a housing wall, a top portion defining an exhaust port, and a bottom portion having a bottom surface. A combustion chamber is positioned therein the interior volume of the housing. The combustion chamber wall has a proximal portion adjacent the top portion of the housing and a distal portion spaced from the bottom surface of the housing. In another aspect, there is a lid that is in sealed relation with the housing wall and the combustion chamber wall. An annulus is defined by the lid, the combustion chamber wall, and the housing wall.

22 Claims, 10 Drawing Sheets

(51) Int. Cl.
*F23D 14/14* (2006.01)
*F23D 14/12* (2006.01)

(56) References Cited

U.S. PATENT DOCUMENTS

| | | | | | |
|---|---|---|---|---|---|
| 4,304,549 | A * | 12/1981 | Pfau | 431/215 |
| 4,375,352 | A * | 3/1983 | Berry et al. | 431/8 |
| 4,643,667 | A | 2/1987 | Fleming et al. | |
| 5,141,432 | A * | 8/1992 | Bell et al. | 431/7 |
| 5,203,690 | A * | 4/1993 | Maruko | 431/236 |
| 5,375,997 | A * | 12/1994 | Nakamura et al. | 431/115 |
| 5,383,445 | A * | 1/1995 | Dixon | 126/110 R |
| 5,782,629 | A * | 7/1998 | Lannutti | 431/326 |
| 5,810,577 | A * | 9/1998 | Ledjeff | 431/170 |
| 6,065,957 | A * | 5/2000 | Kondo et al. | 431/116 |
| 6,065,962 | A * | 5/2000 | Shizukuisha et al. | 431/328 |
| 6,116,516 | A | 9/2000 | Ganan-Calvo | |
| 6,119,953 | A | 9/2000 | Ganan-Calvo et al. | |
| 6,162,046 | A * | 12/2000 | Young et al. | 431/11 |
| 6,174,469 | B1 | 1/2001 | Ganan-Calvo | |
| 6,189,803 | B1 | 2/2001 | Ganan-Calvo | |
| 6,196,525 | B1 | 3/2001 | Ganan-Calvo | |
| 6,198,038 | B1 * | 3/2001 | Shukla et al. | 136/253 |
| 6,241,159 | B1 | 6/2001 | Ganan Calvo et al. | |
| 6,276,313 | B1 * | 8/2001 | Yang et al. | 123/46 E |
| 6,357,670 | B2 | 3/2002 | Ganan-Calvo | |
| 6,386,463 | B1 | 5/2002 | Ganan-Calvo | |
| 6,394,429 | B2 | 5/2002 | Ganan-Calvo | |
| 6,450,189 | B1 | 9/2002 | Ganan-Calvo | |
| 6,554,202 | B2 | 4/2003 | Ganan-Calvo | |
| 6,589,579 | B2 | 7/2003 | Ganan-Calvo | |
| 6,595,202 | B2 | 7/2003 | Ganan-Calvo | |
| 6,758,067 | B2 | 7/2004 | Ganan-Calvo et al. | |
| 6,790,317 | B2 * | 9/2004 | Antal, Jr. | 201/35 |
| 6,792,940 | B2 | 9/2004 | Ganan-Calvo | |
| 6,951,456 | B2 * | 10/2005 | Cohen et al. | 431/215 |
| 7,059,319 | B2 | 6/2006 | Ganan-Calvo | |
| 7,059,321 | B2 | 6/2006 | Ganan-Calvo | |
| 7,279,137 | B2 * | 10/2007 | Alford et al. | 422/129 |
| 7,293,559 | B2 | 11/2007 | Ganan-Calvo | |
| 7,341,211 | B2 | 3/2008 | Ganan Calvo et al. | |
| 7,942,205 | B2 | 5/2011 | Sharif | |
| 8,088,336 | B2 * | 1/2012 | Suzuki et al. | 422/148 |
| 8,122,875 | B2 * | 2/2012 | Kim et al. | 126/92 AC |
| 2002/0042035 | A1 * | 4/2002 | Komiya et al. | 431/268 |
| 2003/0044342 | A1 * | 3/2003 | Alford et al. | 423/445 R |
| 2004/0079301 | A1 * | 4/2004 | Perlo et al. | 123/46 E |
| 2005/0072454 | A1 * | 4/2005 | Cohen et al. | 136/205 |
| 2006/0027258 | A1 * | 2/2006 | Smith et al. | 136/205 |
| 2006/0107663 | A1 * | 5/2006 | Filippone | 60/643 |
| 2006/0112636 | A1 | 6/2006 | Chellappa et al. | |
| 2006/0169800 | A1 | 8/2006 | Rosell et al. | |
| 2007/0063072 | A1 | 3/2007 | Ganan Calvo et al. | |
| 2007/0102533 | A1 | 5/2007 | Rosell et al. | |
| 2008/0053436 | A1 | 3/2008 | Rosell et al. | |
| 2008/0054100 | A1 | 3/2008 | Rosell et al. | |
| 2008/0072895 | A1 | 3/2008 | Ganan Calvo | |
| 2008/0083445 | A1 * | 4/2008 | Chakraborty | 136/205 |
| 2008/0124666 | A1 * | 5/2008 | Stocker et al. | 431/7 |
| 2008/0271350 | A1 * | 11/2008 | Ganan Calvo | 38/77.5 |
| 2009/0007953 | A1 * | 1/2009 | Hsu | 136/205 |
| 2009/0214655 | A1 | 8/2009 | Ganan Calvo et al. | |
| 2009/0215154 | A1 | 8/2009 | Ganan Calvo et al. | |
| 2009/0250532 | A1 | 10/2009 | Ganan Calvo et al. | |
| 2010/0139599 | A1 * | 6/2010 | Vestin | 123/143 B |
| 2011/0168222 | A1 * | 7/2011 | Lee et al. | 136/205 |
| 2012/0292406 | A1 | 11/2012 | Ganan-Calvo | |
| 2014/0000669 | A1 * | 1/2014 | Wong et al. | 136/205 |

FOREIGN PATENT DOCUMENTS

| | | | |
|---|---|---|---|
| ES | 2158741 | A1 | 9/2001 |
| ES | 2255349 | A1 | 6/2006 |
| ES | 2265259 | A1 | 2/2007 |
| ES | 2265270 | A1 | 2/2007 |
| ES | 2277770 | B1 | 6/2008 |
| WO | 9930833 | A1 | 6/1999 |
| WO | 0076673 | A1 | 12/2000 |
| WO | 03066217 | A1 | 8/2003 |
| WO | 2004065019 | A1 | 8/2004 |
| WO | 2005044433 | A1 | 5/2005 |
| WO | 2005044434 | A1 | 5/2005 |
| WO | 2006018462 | A1 | 2/2006 |
| WO | 2006/089984 | | 8/2006 |
| WO | 2007003667 | A1 | 1/2007 |
| WO | 2008148917 | A2 | 12/2008 |
| WO | 2010018261 | A1 | 2/2010 |

* cited by examiner

MESO-SCALED COMBUSTION SYSTEM

FIELD OF THE INVENTION

A combustion system is presented. More specifically, a meso-scaled combustion system is presented.

BACKGROUND OF THE INVENTION

Significant combustion research is being directed at developing small scale combustion systems capable of generating power in the 1 W to 1000 W range. These small scale power systems are envisioned to replace the conventional chemical batteries for portable electronics, where the power source forms a large fraction of the total system weight. The high energy density of fuels and the prospect of converting fuel's chemical energy into power have drawn researchers to the field of micro-electro-mechanical or MEMS engines. However, for practical reasons, recent research has focused on meso-scale systems with the length scale ranging from few mm to few cm. Meso-scale heat engines could provide high efficiency and longevity, unattainable with MEMS devices. Combustion at small scales is also a topic of significant fundamental research because of the challenges it presents in terms of fuel-air mixing and combustion efficiency.

SUMMARY OF THE INVENTION

A meso-scaled combustion system is presented. In one aspect, the system comprises a housing having a housing wall, a top portion defining an exhaust port, and a bottom portion having a bottom surface. The housing wall defines an interior volume and at least one fuel injector port therethrough a portion of the housing wall. A combustion chamber is positioned therein the interior volume of the housing. The combustion chamber wall has a proximal portion adjacent the top portion of the housing and a distal portion spaced from the bottom surface of the housing. In another aspect, there is a lid that is in sealed relation with the housing wall and the combustion chamber wall. An annulus is defined by the lid, the combustion chamber wall, and the housing wall.

These and other objects of the present invention will be clear when taken in view of the detailed specification and disclosure in conjunction with the appended figures.

DETAILED DESCRIPTION OF THE DRAWINGS

The accompanying drawings, which are incorporated in and constitute a part of this specification, illustrate certain aspects of the instant invention and together with the description, serve to explain, without limitation, the principles of the invention. Like reference characters used therein indicate like parts throughout the several drawings.

Figure 1:
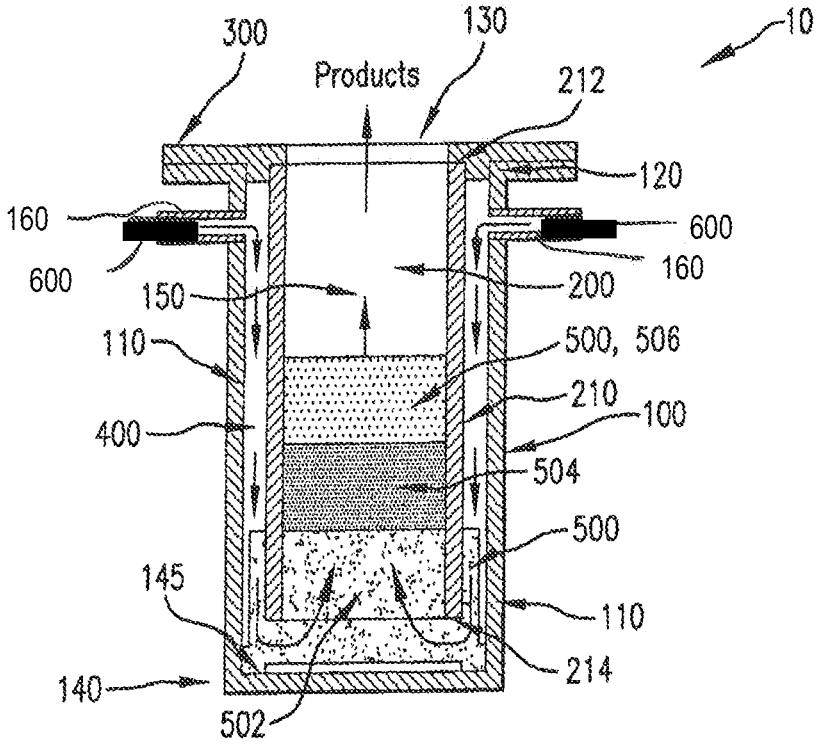
FIG. 1 is side cross-sectional view of one aspect of the combustion system.
Figure 2:
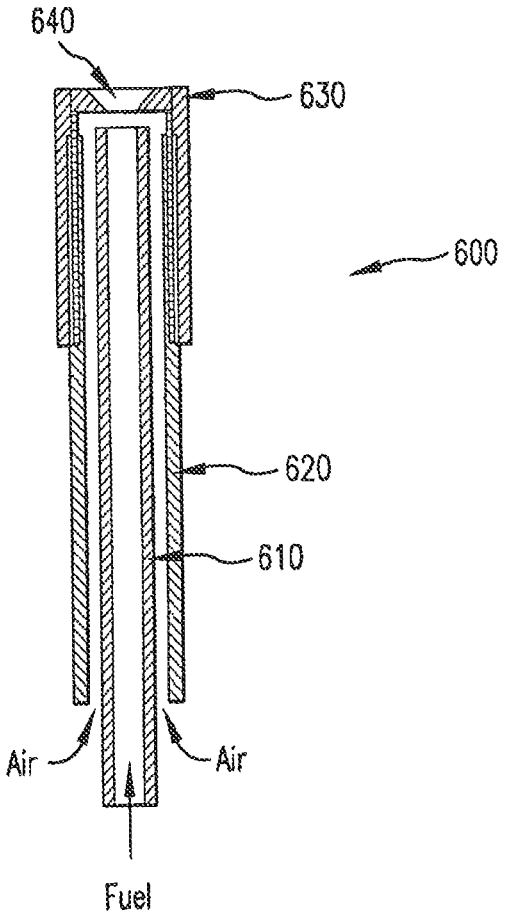
FIG. 2 is a side cross-sectional view of a fuel-blurring injector, according to one aspect.
Figure 3A:
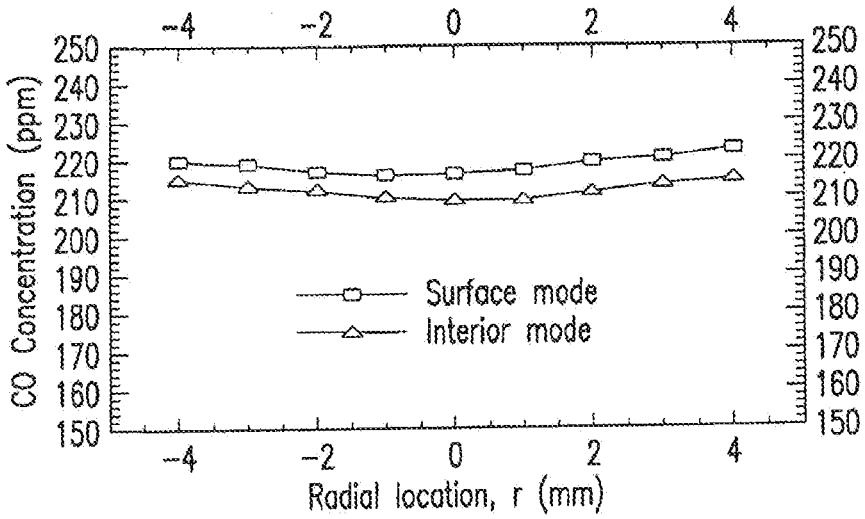
Figure 3B:
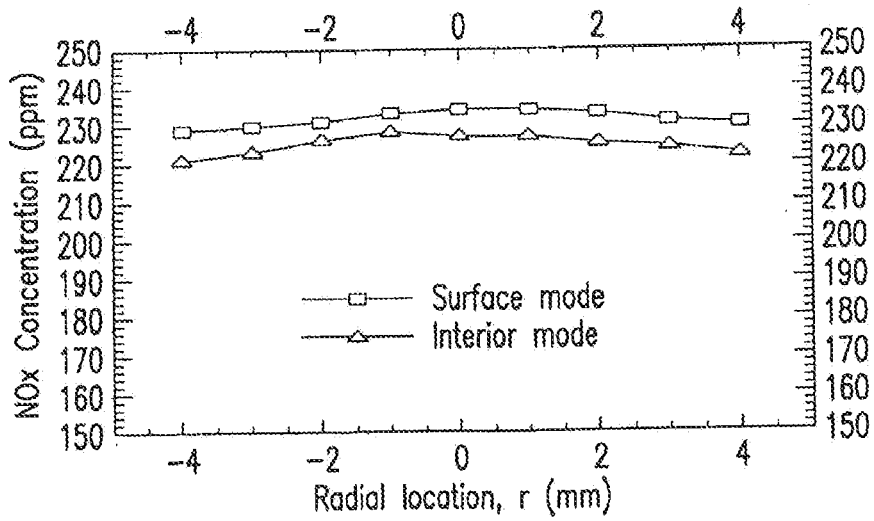
Figure 4A:
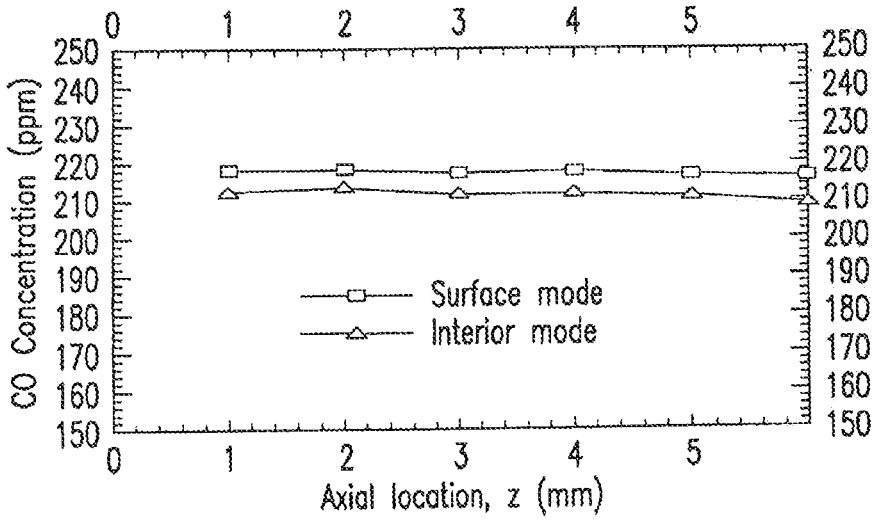
Figure 4B:
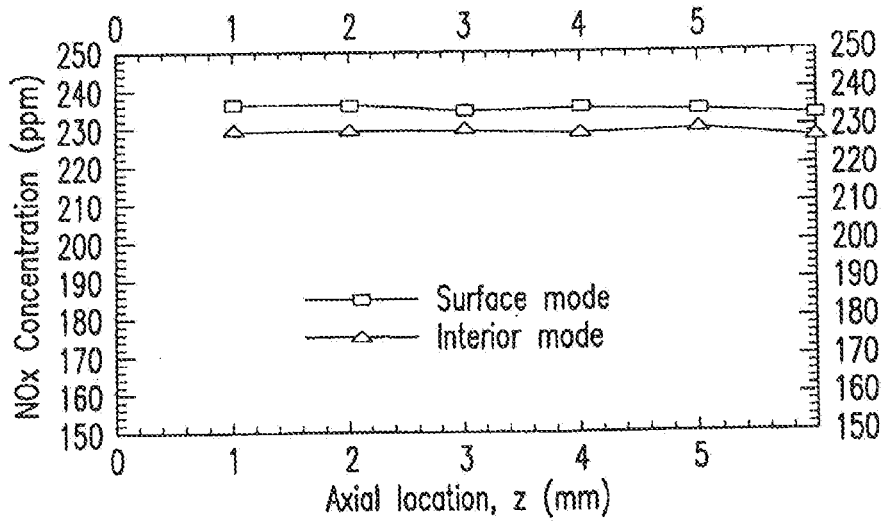
Figure 5A:
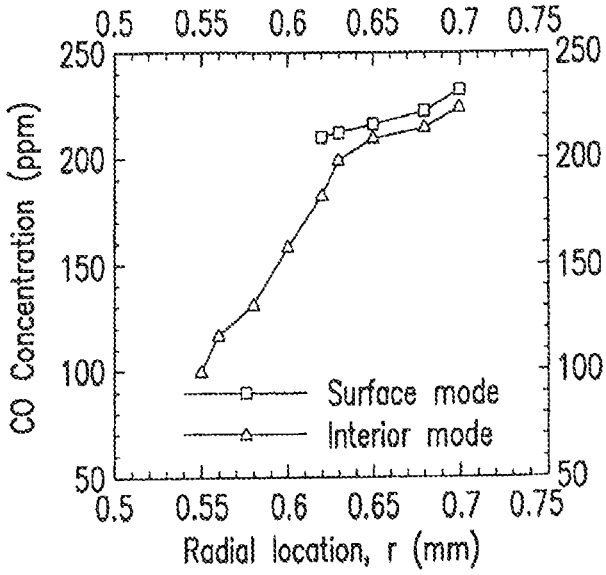
Figure 5B:
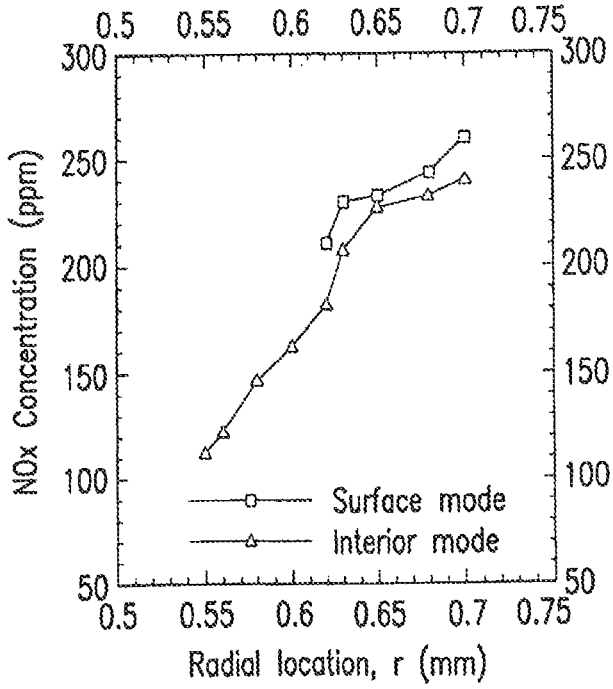
Figure 6:
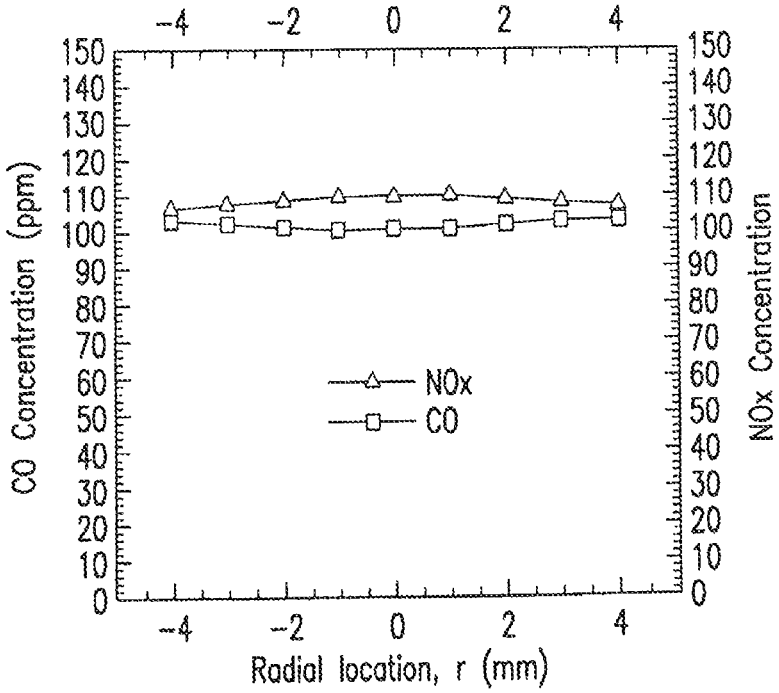
Figure 7:
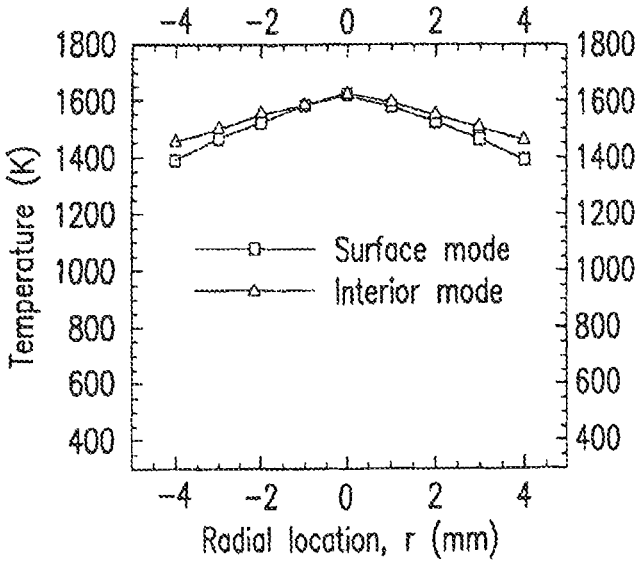
Figure 8:
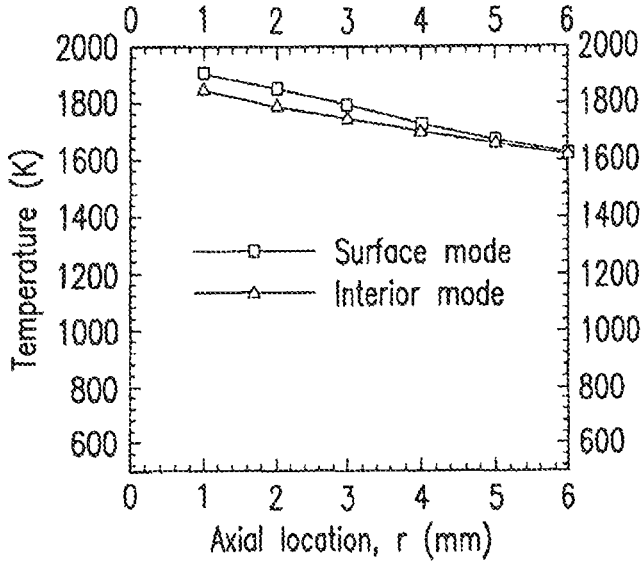
Figure 9:
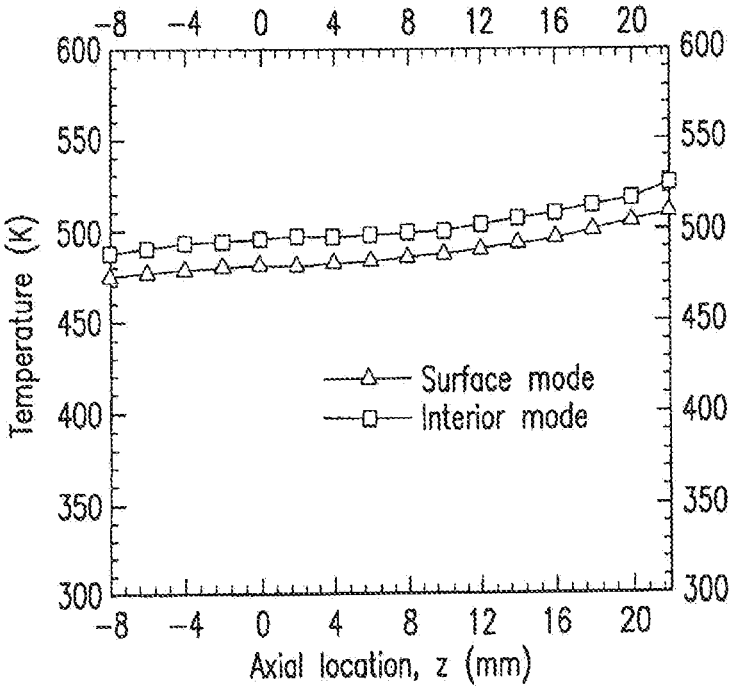
Figure 10:
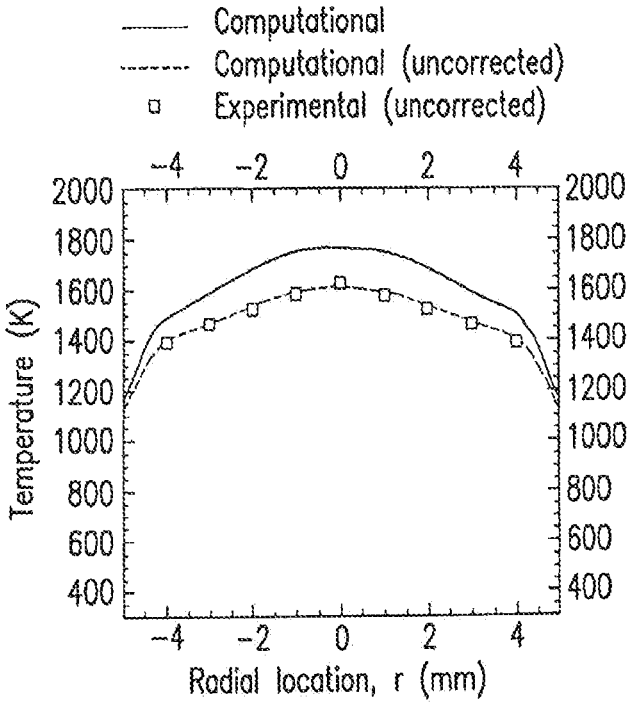
Figure 11:
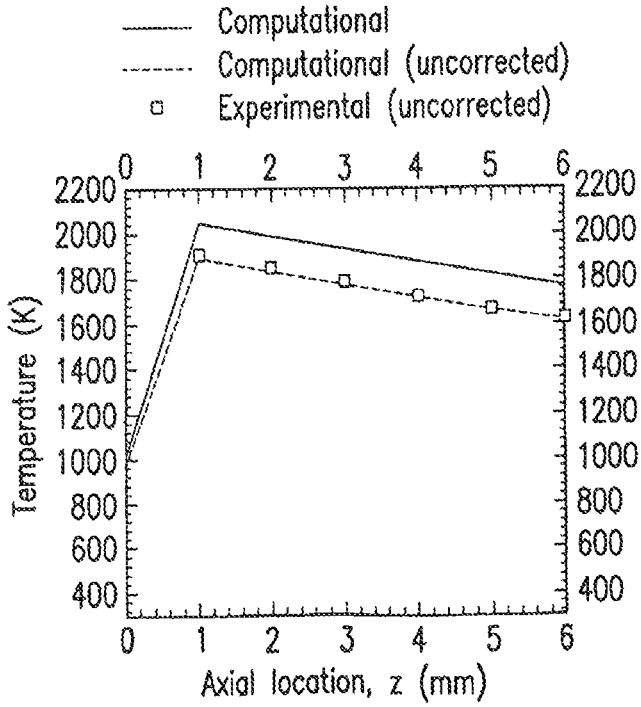
Figure 12:
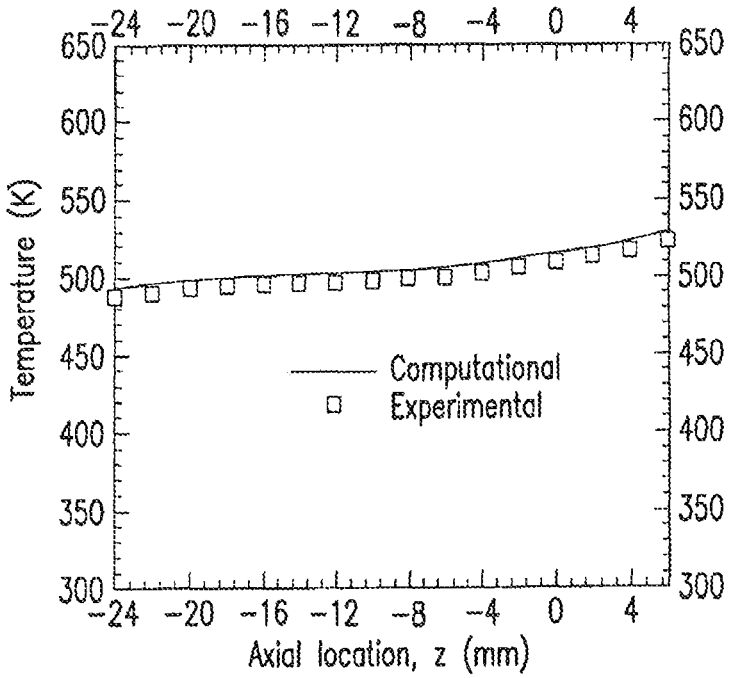

FIGS. 3*a* and 3*b* are radial profiles of (a) CO and (b) NOx concentrations at combustor of FIG. 1, where the exit plane, $\dot{m}_f$=40 g/hr, Φ=0.65;

FIGS. 4*a* and 4*b* are a xial profiles of (a) CO and (b) NOx concentrations at the combustor center line of the combustor of FIG. 1, where (r=0 mm), $\dot{m}_f$=40 g/hr, Φ=0.65;

FIG. 5 shows the effect of equivalence ratio on (a) CO and (b) NOx concentrations at center (r=0 mm) of the combustor of FIG. 1;

FIG. 6 illustrates radial profiles of CO and NOx concentrations at exhaust port of the combustor of FIG. 1, where $\dot{m}_f$=40 g/hr, Φ=0.65;

FIG. 7 illustrates measured temperature profiles at the exhaust port of the combustor of FIG. 1, where $\dot{m}_f$=40 g/hr, Φ=0.65;

FIG. 8 illustrates measured temperature profiles at the centerline of the combustor tube of the combustor of FIG. 1, where $\dot{m}_f$=40 g/hr, Φ=0.65;

FIG. 9 illustrates a temperature profile on the exterior surface of the combustor of FIG. 1, where $\dot{m}_f$=40 g/hr, Φ=0.65;

FIG. 10 illustrates the measured and computed temperature profiles of product gas temperature at exhaust port of the combustor of FIG. 1;

FIG. 11 illustrates measured and computed temperature profiles of product gas temperature at centerline of combustor tube of the combustor of FIG. 1; and FIG. 12 illustrates measured and computed temperature profile on exterior surface of the combustor of FIG. 1.

DETAILED DESCRIPTION OF THE INVENTION

The present invention may be understood more readily by reference to the following detailed description of the invention and the Examples included therein and to the Figures and their previous and following description.

Before the present systems, articles, devices, and/or methods are disclosed and described, it is to be understood that this invention is not limited to specific systems, specific devices, or to particular methodology, as such may, of course, vary. It is also to be understood that the terminology used herein is for the purpose of describing particular embodiments only and is not intended to be limiting.

The following description of the invention is provided as an enabling teaching of the invention in its best, currently known embodiment. To this end, those skilled in the relevant art will recognize and appreciate that many changes may be made to the various aspects of the invention described herein, while still obtaining the beneficial results of the present invention. It will also be apparent that some of the desired benefits of the present invention may be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used in the specification and the appended claims, the singular forms "a," "an" and "the" include plural referents unless the context clearly dictates otherwise. Thus, for example, reference to "a fuel injector" comprises two or more such fuel injectors, and the like.

Ranges may be expressed herein as from "about" one particular value, and/or to "about" another particular value. When such a range is expressed, another embodiment comprises from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed.

It is also understood that when a value is disclosed that "less than or equal to" the value, "greater than or equal to the value" and possible ranges between values are also disclosed, as appropriately understood by the skilled artisan. For example, if the value "10" is disclosed the "less than or equal to 10" as well as "greater than or equal to 10" is also disclosed. It is also understood that throughout the application, data is provided in a number of different formats and that this data represents endpoints and starting points, and ranges for any combination of the data points. For example, if a particular data point "10" and a particular data point 15 are disclosed, it is understood that greater than, greater than or equal to, less than, less than or equal to, and equal to 10 and 15 are considered disclosed as well as between 10 and 15. It is also understood that each unit between two particular units are also disclosed. For example, if 10 and 15 are disclosed, then 11, 12, 13, and 14 are also disclosed.

"Optional" or "optionally" means that the subsequently described event or circumstance may or may not occur, and that the description comprises instances where said event or circumstance occurs and instances where it does not.

Presented is a meso-scaled combustion system 10. In one aspect, the system 10 comprises a housing 100 having a housing wall 110, a top portion defining an exhaust port 130, and a bottom portion 140 having a bottom surface 145. The housing wall 110 defines an interior volume 150 and at least one fuel injector port 160 therethrough a portion of the housing wall. A combustion chamber 200 is positioned therein the interior volume 150 of the housing 100. The combustion chamber wall 210 has a proximal portion 212 adjacent the top portion 120 of the housing and a distal portion 214 spaced from the bottom surface 145 of the housing. In another aspect, there is a lid 300 that is in sealed relation with the housing wall and the combustion chamber wall 210. An annulus 400 is defined by the lid 300, the combustion chamber wall 210, and the housing wall 110. FIG. 1 shows a schematic drawing of one aspect of the system showing the housing, the combustion chamber 200 concentric inside the housing 100, layers of the porous inert media 500 ("PIM"), and the lid. Liquid fuel and air may be injected from one or more injection ports on the periphery of the housing. In one aspect, the liquid fuel is kerosene. In this aspect, the fuel is atomized, pre-vaporized, and pre-mixed with air in the annulus 400 before reaching the combustion chamber. The flame may be stabilized either on the downstream surface of the top layer 506 of PIM or in the interior of the PIM.

In one aspect, the PIM comprises silicon carbide. In another aspect, the PIM comprises a plurality of layers of PIM. For example, in one aspect, there can be three layers of PIM. In this aspect, the first 502, second 504, and third 506 layers of PIM can be in stacked relationship with the third layer 506 having a top portion exposed to the atmosphere. In another aspect, the first and third layers can have the same density. In yet another aspect, the second layer can have a density higher than that of the first and third layers. In this aspect, the higher density of the second layer can help prevent flash back, where the flame propagates upstream of the combustion chamber 200. For example, in one aspect, the first and third layers have a density of 16 ccpm, and the second layer has a density of 32 ccpm.

In one aspect, all components except for the PIM may be about 1 mm thick. In one aspect, the combustion chamber comprises an inner diameter of about 10 mm. In another aspect, the housing comprises an inner diameter of about 15 mm. In this aspect, the overall system is 30 mm long and 17 mm in diameter with an overall volume of 6.8 $cm^3$. Also, in this aspect, the volume of the combustion chamber is 2 $cm^3$, which is about an order of magnitude smaller than the previously reported liquid-fueled meso-scale combustor. Other dimensions are contemplated and are within the scope of engineering design.

In another aspect, the combustion chamber wall comprises 304-stainless steel. In yet another aspect, the housing and the lid may be made a non thermally conductive material. For example, the housing 100 and the lid 300 may comprise alumino-silicate ceramic with a thermal conductivity of 1.6 W/mK. This ceramic can withstand temperatures up to 800 K, and may minimize the conduction heat transfer from combustion chamber wall to the outer surfaces, and still provided the needed structural rigidity.

Liquid fuel vaporization and mixing with air are controlling factors in low-emission operation of a liquid-fuel combustor. Thus, in one aspect, the liquid fuel is dispersed into small droplets that can vaporize rapidly and pre-mix with air. In one aspect, the fuel injector comprises a flow-blurring injector 600. In one aspect, in the flow-blurring injector, a back flow of atomizing air can be created within the fuel supply tube to form a spray with fine droplets. The flow-blurring injector may comprise an inner injector tube 610, an outer injector tube 620, and an end cap 630 spaced therefrom the inner injector tube. The end cap defines an outlet port 640. In operation, the air-fuel mixture exits the outlet port and is injected into the annulus.

Experiments were conducted with combustion air supplied by a compressor, dried, and then measured by a calibrated mass flowmeter. Kerosene fuel was supplied by a high precision piston-cylinder fuel-pump. The product gas was sampled at the exhaust port 130 using a quartz probe with a tapered tip to quench the reactions. Electrochemical gas analyzers were used to measure dry product concentrations of oxygen ($O_2$) with an uncertainty of 1%, and nitric oxides (NOx) and carbon monoxide (CO) with an uncertainty of ±2 ppm. The equivalence ratio was determined from the $O_2$ concentration in the product gas. The outer surface temperature was measured by an infrared thermal imaging camera. The product gas temperature was measured by an R-type thermocouple of 0.075 mm bead diameter.

In one aspect, a finite volume based computational model was developed to analyze the system performance. The conservation equations for mass, momentum, and energy were solved in an axi-symmetric domain. The model incorporated conjugate heat transfer, radiation heat transfer and heat transfer within porous media 500. Discrete ordinates model was used to simulate radiation heat transfer. The porous media was modeled as a sink term in the momentum equations. Combustion was simulated as a thin source of heat release; an assumption that is substantiated by experiments. Polynomial curve fits from were used to specify temperature dependent viscosity, specific heat capacity, and thermal conductivity of air. The governing equations were discretized using finite volume technique with first-order upwind scheme and SIMPLE algorithm. A non-uniform grid with 151 axial and 101 radial points was used to obtain grid independent solution. Typical runs required about 4000 iterations and 3 to 5 hrs of CPU time on a personal computer.

In one aspect, the flame can be stabilized in the interior of the PIM. In this aspect, it has been shown that the reaction zone is a bright orange glow rather than a blue flame observed for a flame that was stabilized on the surface of the PIM. In one aspect, the fuel flow rate ($\dot{m}_f$) can be from about 3 grams/hr to about 100 grams/hr. In another aspect, the fuel flow rate can be 40 g/hr. Also, in one aspect, the equivalence ratio ($\Phi$) can be from about 0.5 to about 0.8. In another aspect, the equivalence ration can be about 0.65. The fuel flow rates correspond to heat release rate from about 200 W to about 5 kW.

Experiments were first conducted for combustion in surface mode. Subsequently, for experiments with interior mode of combustion, the air flow rate was gradually reduced to make the flame richer with Φ=0.75. At this high equivalence ratio, the flame slowly propagated into the PIM and gradually stabilizes in interior mode. With the flame stabilized in the interior mode, the air flow rate was gradually increased till an equivalence ratio of 0.65 was achieved. Thus, both surface mode and interior mode of combustion were achieved with substantially similar operating conditions.

FIGS. 3(*a*) and 3(*b*) present radial profiles of CO and NOx concentrations at the exhaust port. Both CO and NOx concentration profiles were nearly uniform in the experiment, except for slightly higher CO concentrations and lower NOx concentrations adjacent to the wall. The minor shift in CO and NOx concentrations in the wall region is attributed to the quenching effect associated with the heat loss from the combustion chamber wall. The CO concentrations are within 225 ppm and NOx concentrations are within 235 ppm. These results show excellent combustion uniformity at the combustor exit.

A comparison between the surface mode and interior mode of combustion shows a slight reduction in both CO and NOx emissions when the combustor is operated in interior mode. This result is due to the higher thermal feedback from the flame region to the reactants in case of the interior mode of combustion. The CO and NOx concentrations at the combustor center line (r=0 mm) are shown in FIG. 4. Both CO and NOx concentrations remain constant along the axial location. This result illustrates that the reactions are completed within a short reaction zone. The combustion process is efficient both in surface and interior modes. The interior mode is shown to curtail the emissions.

Since combustion in interior mode is less sensitive to changes in equivalence ratio and combustion may be sustained at lower equivalence ratios, experiments were conducted to determine the operable limits of the combustor in surface and interior combustion modes. The fuel flow rate was kept constant at 40 g/hr and the air flow rate was varied to vary the equivalence ratio. For surface combustion mode, the lean blow off (LBO) limit was determined by gradually increasing the air flow rate (thereby reducing the equivalence ratio) till the flame becomes unstable and eventually blows out. The LBO limit for interior mode was determined by gradually increasing the air flow rate till the flame begins to propagate downstream to stabilize in the surface mode.

FIG. 5(*a*) and (b) show the effect of equivalence ratio on CO and NOx emissions. The lowest equivalence ratio in FIG. 5 indicates the LBO limit. It is evident that in interior mode, the combustor may be operated at leaner condition (Φ=0.55) compared to surface mode, where the LBO limit is Φ=0.62. In one experiment, the highest equivalence ratio for both modes of combustion was limited to 0.7 in producing lower emissions. Both CO and NOx concentrations decrease with decrease in the equivalence ratio.

Since the combustor can operate at leaner equivalence ratio in interior mode, experiments were conducted at Φ=0.55 to attain lower CO and NOx emissions. FIG. 6 shows the radial profiles of CO and NOx concentrations at the exhaust port for $\dot{m}_f$=40 g/hr and Φ=0.55. Results show a drastic reduction in emissions; both CO and NOx concentrations are within 110 ppm, which represents about a 50% reduction compared to previous data in FIG. 3 for Φ=0.65. Thus, the present system can minimize pollutant emissions in addition to achieving good thermal performance.

FIG. 7 presents the radial profile of product gas temperature at the exhaust port for Φ=0.65. The temperature profiles are parabolic in nature with peak temperature attained at the center of the combustor. The temperature at the wall region is lower because of the heat transfer from the combustion products to the reactants in the annulus. Although the peak temperatures attained at the center of the combustor are nearly the same for surface and interior modes, the temperatures near the wall region are lower for the surface combustion mode. This result indicates higher heat loss, as detailed in following sections, when the combustor is operated in surface mode of combustion compared to the interior mode. The temperature measurements in FIG. 7 are not corrected for radiation and conduction losses from the thermocouple.

The axial variation in product gas temperature at the center line of the combustor tube is shown in FIG. 8 for equivalence ratio of 0.65. FIG. 8 shows that the temperature decreases linearly along the flow direction, indicating heat transfer to the reactants in the annulus. The temperature in the reaction zone, in one aspect, is super-adiabatic (adiabatic flame temperature, $T_{ad}$=1800 K), due of the pre-heating of the reactants in the annulus and PIM zone(s) upstream of the flame region.

FIG. 9 shows the exterior surface temperature measured by the infrared camera. Results show that the exterior surface temperature is the lowest near the base. The exterior surface temperature increases near the lid region, possibly because of the axial conduction through the combustor tube and further to the lid. A comparison of the exterior surface temperature for the two modes of combustion reveals higher surface temperature for the surface mode of combustion. This result indicates higher heat loss from the system when the combustor is operated in the surface mode.

Experimentally obtained temperature profiles were compared with the computational results to validate the numerical model. FIG. 10 shows the radial variation of product gas temperature pertaining to the results in FIG. 7 for surface combustion mode. FIGS. 11 and 12 illustrate agreement between experimental and computational temperature profiles (uncorrected) for axial product gas temperature and the exterior surface temperature.

The ignition source for the system can be positioned upstream of the PIM or it can be positioned within the PIM itself. It is contemplated that conventional ignition means may be used.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed herein above, and that many modifications and other embodiments are intended to be included within the scope of the appended claims.

Moreover, although specific terms are employed herein, as well as in the claims which follow, they are used only in a generic and descriptive sense, and not for the purposes of limiting the described invention, nor the claims which follow.

What is claimed is:

1. A meso-scaled combustion system, comprising:

a housing comprising a housing wall, a top portion defining a central exhaust port, and a bottom portion having a bottom surface, wherein the housing wall defines an interior volume, and at least one fuel injector port extends through a portion of the housing wall;

a combustion chamber within the interior volume of the housing having a combustion chamber wall, wherein a proximal portion of the combustion chamber wall is adjacent the top portion of the housing and a distal portion of the combustion chamber wall is spaced from the bottom surface of the housing;

a lid in sealed relation with the housing wall and the combustion chamber wall, wherein portions of the lid, the combustion chamber wall, and the housing wall define an annulus;

porous inert media positioned near the bottom portion of the housing, extending into the combustion chamber and into a portion of the annulus; and a fuel injector assembly configured for injecting a fuel-air mixture through the fuel injector port, wherein said porous inert media comprises first, second, and third layers, the second layer positioned between the first and the third layers, and the second layer comprising higher density porous media than the first and third layers to prevent flashbacks and the third layer exposed to the atmosphere.

2. The meso-scaled combustion system of claim 1, wherein the first and third densities are substantially the same.

3. The meso-scaled combustion system of claim 1, wherein the fuel injector assembly comprises a flow blurring injector, the flow blurring injector comprising:

an inner injector tube;

an outer injector tube spaced radially around a portion of the inner injector tube; and an end cap spaced apart from the inner injector tube and radially around a portion of the outer injector tube and defining an outlet port, the outlet port being spaced axially above an outlet of the inner injector tube and an outlet of the outer injector tube, and the outlet port having a frustoconical shape, wherein the frustoconical shape of the outlet port has an inner, proximal diameter that is the same as an inner diameter of the inner injector tube and an inner, distal diameter spaced axially above the inner proximal diameter that is larger than the inner, proximal diameter of the frustoconical shape.

4. The meso-scaled combustion system of claim 3, further comprising a pressurized source of fuel.

5. The meso-scaled combustion system of claim 4, further comprising a pressurized source of air.

6. The meso-scaled combustion system of claim 4, wherein the inner injector tube is in fluid communication with the pressurized source of fuel.

7. The meso-scaled combustion system of claim 5, wherein the outer injector tube is in fluid communication with the pressurized source of air.

8. The meso-scaled combustion system of claim 3, wherein the fuel-air mixture is injected into the annulus via the outlet port.

9. The meso-scaled combustion system of claim 4, wherein the fuel is kerosene.

10. The meso-scaled combustion system of claim 1, wherein the fuel-air mixture is provided at an equivalence ratio of between about 0.5 and about 0.8.

11. The meso-scaled combustion system of claim 1, wherein fuel in the fuel-air mixture is provided at a flow rate from about 3 grams/hr to about 100 grams/hr.

12. The meso-scaled combustion system of claim 11, wherein the fuel in the fuel-air mixture is provided at a flow rate of about 40 grams/hr.

13. The meso-scaled combustion system of claim 1, wherein the system has a heat release rate from about 200 watts to about 5 kilowatts.

14. The meso-scaled combustion system of claim 1, wherein the system produces an adiabatic flame temperature of about 1800 K.

15. The meso-scaled combustion system of claim 1, wherein the combustion chamber has a volume of from about 1.0 $cm^3$ to about 4.0 $cm^3$.

16. The meso-scaled combustion system of claim 15, wherein the combustion chamber has a volume of about 2.0 $cm^3$.

17. The meso-scaled combustion system of claim 1, wherein the porous inert media comprises silicon carbide.

18. The meso-scaled combustion system of claim 1, wherein at least a portion of the combustion chamber wall comprises a thermally conductive material.

19. The meso-scaled combustion system of claim 18, wherein the thermally conductive material comprises 304 stainless steel.

20. The meso-scaled combustion system of claim 1, wherein at least a portion of the housing comprises alumino-silicate ceramic.

21. The meso-scaled combustion system of claim 1, wherein at least a portion of the lid comprises alumino-silicate ceramic.

22. The meso-scaled combustion system of claim 1, wherein the housing wall extends axially between the top portion and the bottom portion, and the lid defines a central opening in fluid communication with the exhaust port, wherein the exhaust port extends axially from the combustion chamber.

* * * * *